US007458920B2

(12) United States Patent
Hallar

(10) Patent No.: US 7,458,920 B2
(45) Date of Patent: Dec. 2, 2008

(54) WEIGHT CASE

(75) Inventor: James H. Hallar, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 125 days.

(21) Appl. No.: 11/449,099

(22) Filed: Jun. 8, 2006

(65) Prior Publication Data

US 2007/0287608 A1 Dec. 13, 2007

(51) Int. Cl.
*A63B 21/078* (2006.01)
*B65D 85/00* (2006.01)
*B65D 69/00* (2006.01)

(52) U.S. Cl. ..... 482/104; 482/910; 206/445; 206/303; 206/579; 206/315.1

(58) Field of Classification Search ..... 482/910, 482/104, 106, 108; 190/109, 901; 206/445, 206/303, 579, 315.1; 220/4.01, 507; D21/679–682
See application file for complete search history.

(56) References Cited

U.S. PATENT DOCUMENTS

| | | | | |
|---|---|---|---|---|
| 1,951,894 | A | 3/1934 | Ziebarth | |
| 2,261,605 | A | 11/1941 | Smith | |
| D180,490 | S | 6/1957 | Lunan | |
| D202,322 | S | 9/1965 | Kelley | |
| 3,266,605 | A | 8/1966 | Anderson et al. | |
| D216,349 | S | 12/1969 | Bomeisler et al. | |
| 3,524,564 | A | 8/1970 | Schurman | |
| D221,821 | S | 9/1971 | Genaro et al. | |
| 3,724,617 | A | 4/1973 | Lawler | |
| D232,597 | S | 8/1974 | Sias | |
| D233,179 | S | 10/1974 | Sias | |
| D235,036 | S | 4/1975 | Shigeaki | |
| D237,419 | S | 10/1975 | Lapins | |
| D245,479 | S | 8/1977 | Malcolm | |
| D267,370 | S | 12/1982 | Cline | |
| D268,457 | S | 4/1983 | Bellini | |
| D270,302 | S | 8/1983 | Starzec | |
| 4,431,185 | A | 2/1984 | Cisneros | |
| D272,869 | S | 3/1984 | Davis | |
| 4,477,074 | A | 10/1984 | Bushnell | |
| 4,753,329 | A * | 6/1988 | Choy | 190/111 |
| 4,756,416 | A * | 7/1988 | Johnson | 206/335 |
| 4,830,154 | A * | 5/1989 | Gerch et al. | 190/103 |
| 4,951,812 | A | 8/1990 | Chen | |
| D349,628 | S | 8/1994 | Kahl et al. | |
| D351,727 | S | 10/1994 | Tarozzi | |
| 5,427,453 | A * | 6/1995 | Cloessner | 383/38 |

(Continued)

*Primary Examiner*—Loan H Thanh
*Assistant Examiner*—Allana Lewin
(74) *Attorney, Agent, or Firm*—Faegre & Benson LLP

(57) ABSTRACT

A method of displaying exercise weight components in a retail environment includes disposing a weight case in a retail environment, the weight case including a bottom member and a first side wall attached to the bottom member, the first side wall including a opening formed into an outer face of the first side wall and adapted to maintain an exercise weight component in a substantially upright manner with the bottom member resting on a support surface. A plurality of exercise weight components is maintained by the weight case, at least one of the plurality of weight components maintained in the opening of the first side wall. The exercise weight component maintained in the opening of the first side wall is presented to an observer.

10 Claims, 12 Drawing Sheets

U.S. PATENT DOCUMENTS

| | | | | |
|---|---|---|---|---|
| D360,757 | S | 8/1995 | Snetting et al. | |
| 5,447,216 | A | 9/1995 | Freyvogel | |
| D369,677 | S | 5/1996 | Bussmann et al. | |
| D369,901 | S | 5/1996 | Laube | |
| D379,715 | S | 6/1997 | Yemini | |
| 5,697,870 | A | 12/1997 | Osborn | |
| D392,803 | S | 3/1998 | Pohlman | |
| D393,945 | S | 5/1998 | Urvoy | |
| 5,799,789 | A | 9/1998 | Ritchie et al. | |
| 5,813,953 | A | 9/1998 | Whipple | |
| D403,860 | S | 1/1999 | Ritchie et al. | |
| D406,192 | S | 3/1999 | Schurman | |
| 5,997,442 | A | 12/1999 | Cordes | |
| 6,093,136 | A | 7/2000 | Whipple | |
| 6,123,651 | A | 9/2000 | Ellenburg | |
| D459,074 | S | 6/2002 | Eckmann | |
| 6,523,653 | B2 * | 2/2003 | Roegner | 190/109 |
| 6,575,273 | B1 * | 6/2003 | Bergkvist et al. | 190/114 |
| 6,644,448 | B2 * | 11/2003 | Bernbaum et al. | 190/111 |
| 7,066,327 | B2 | 6/2006 | Baublitz et al. | |
| 7,134,548 | B2 | 11/2006 | Meehan et al. | |
| 2003/0015445 | A1 | 1/2003 | Levy | |
| 2004/0035748 | A1 | 2/2004 | Hernandez, Jr. et al. | |
| 2005/0115849 | A1 | 6/2005 | Nally | |

* cited by examiner

WEIGHT CASE

CROSS-REFERENCE TO RELATED APPLICATIONS

The present application is related to U.S. Design patent application Ser. No. 29/261,138, entitled "WEIGHT CASE," referenced as T634.177.101, filed on Jun. 8, 2006, and the contents of which are incorporated herein by reference.

BACKGROUND OF THE INVENTION

The health and fitness industry has undergone explosive growth as people have increasingly realized the importance of healthy living and exercise. Along with improving diet, people have become increasingly motivated to engage in regular exercise and fitness training. Weight lifting, sometimes termed "resistance training," is an example.

By their very nature, exercise weights can be heavy and difficult to move. For example, a purchaser desiring to move a weight set from a display point to a point of sale (POS) or other location often has to make several trips to move components of the weight set, use heavy and unwieldy carts, or otherwise be inconvenienced. Additionally, retailers face the challenge of simultaneously presenting an appealing and informative display of a weight set and securely packaging the weight set for transportation.

SUMMARY OF THE INVENTION

Some aspects of the present invention relate to weight cases and methods of displaying exercise weight components in a retail environment. For example, a method of displaying exercise weight components in a retail environment includes disposing a weight case in a retail environment, the weight case including a bottom member and a first side wall attached to the bottom member, the first side wall including a opening formed into an outer face of the first side wall and adapted to maintain an exercise weight component in a substantially upright manner with the bottom member resting on a support surface. A plurality of exercise weight components is maintained by the weight case, at least one of the plurality of weight components maintained in the opening of the first side wall. The exercise weight component maintained in the opening of the first side wall is presented to an observer.

While some aspects of the invention have been described above, other related products and methods are also disclosed and provide additional advantages.

BRIEF DESCRIPTION OF THE DRAWINGS

Embodiments of the invention are described with respect to the figures, in which like reference numbers denote like elements, and in which.

DETAILED DESCRIPTION

Figure 1:
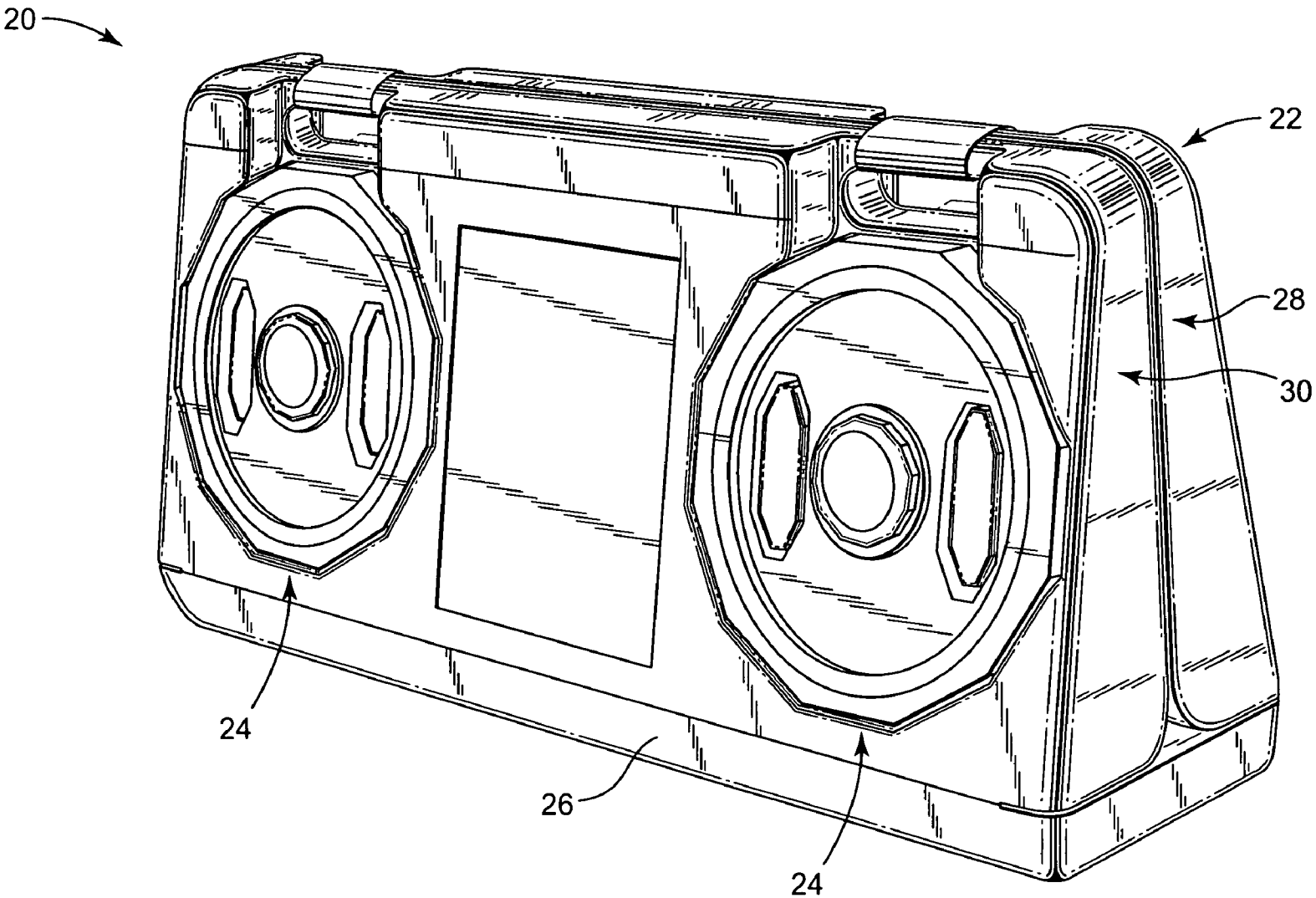
FIG. 1 is a perspective view of an exercise weight package including a weight case and exercise weight components, according to an embodiment of the present invention.

FIG. 1 shows an exercise weight package 20 including a weight case 22 and exercise weight components 24. In general terms, the weight case 22 is shown in a closed state and includes a base 26, also described as a base member or a central member, a first side wall 28, also described as a first side member or a first wall, and a second side wall 30, also described as a second side member or a second wall. The exercise weight components 24 are shown mounted to, and supported by, the first side wall 28 in a substantially vertical, or upright, position. As will be understood with reference to the text that follows, the exercise weight components 24 include weight plates, such as those commonly used in association with barbells; as well as barbell components, such as portions of a bar that are later assembled into a full length bar; collars for securing weight plates to the bar; and other components associated with exercise weights.

Figure 2:
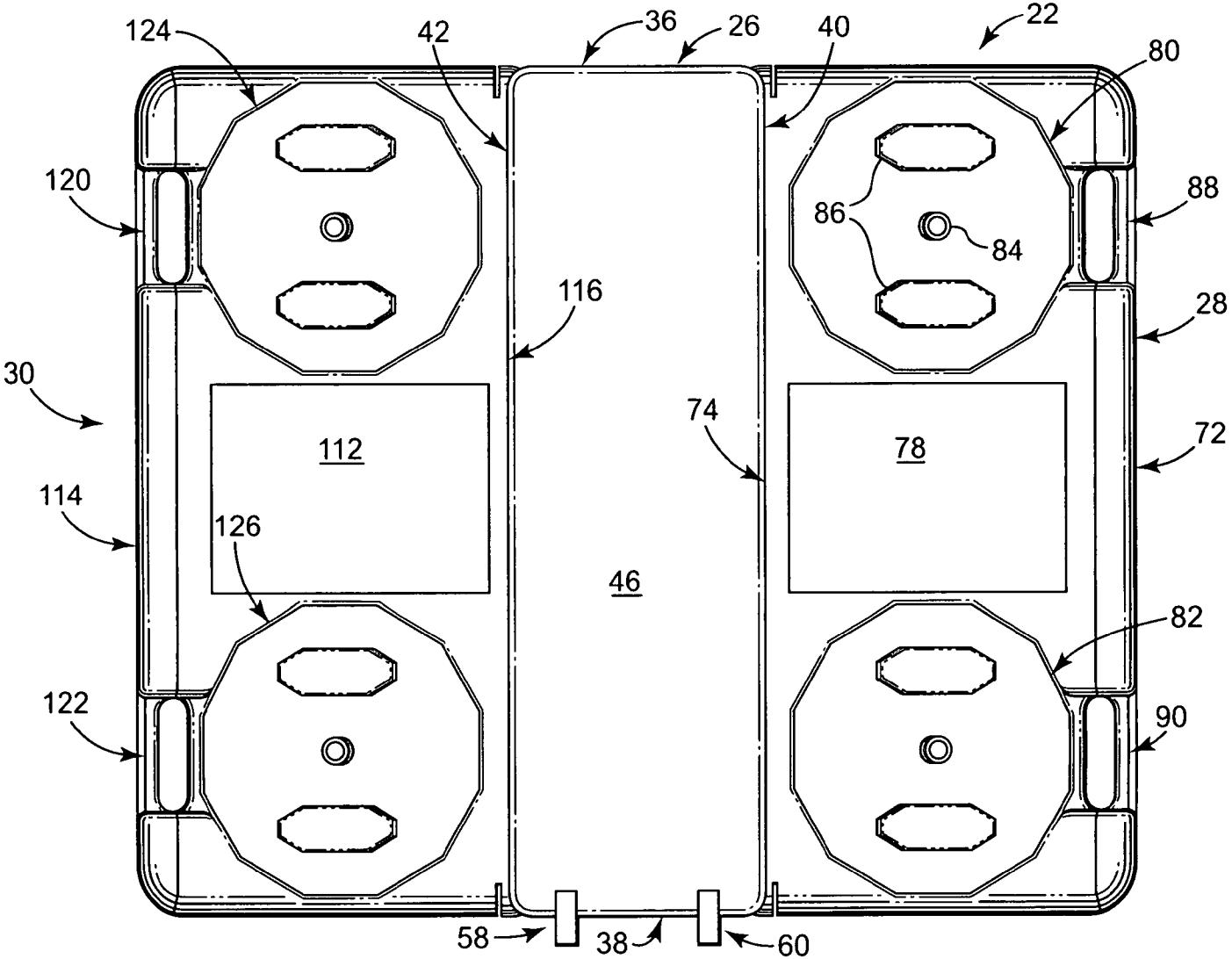
FIG. 2 is a bottom view of a weight case in an open state, according to an embodiment of the present invention.
Figure 3:
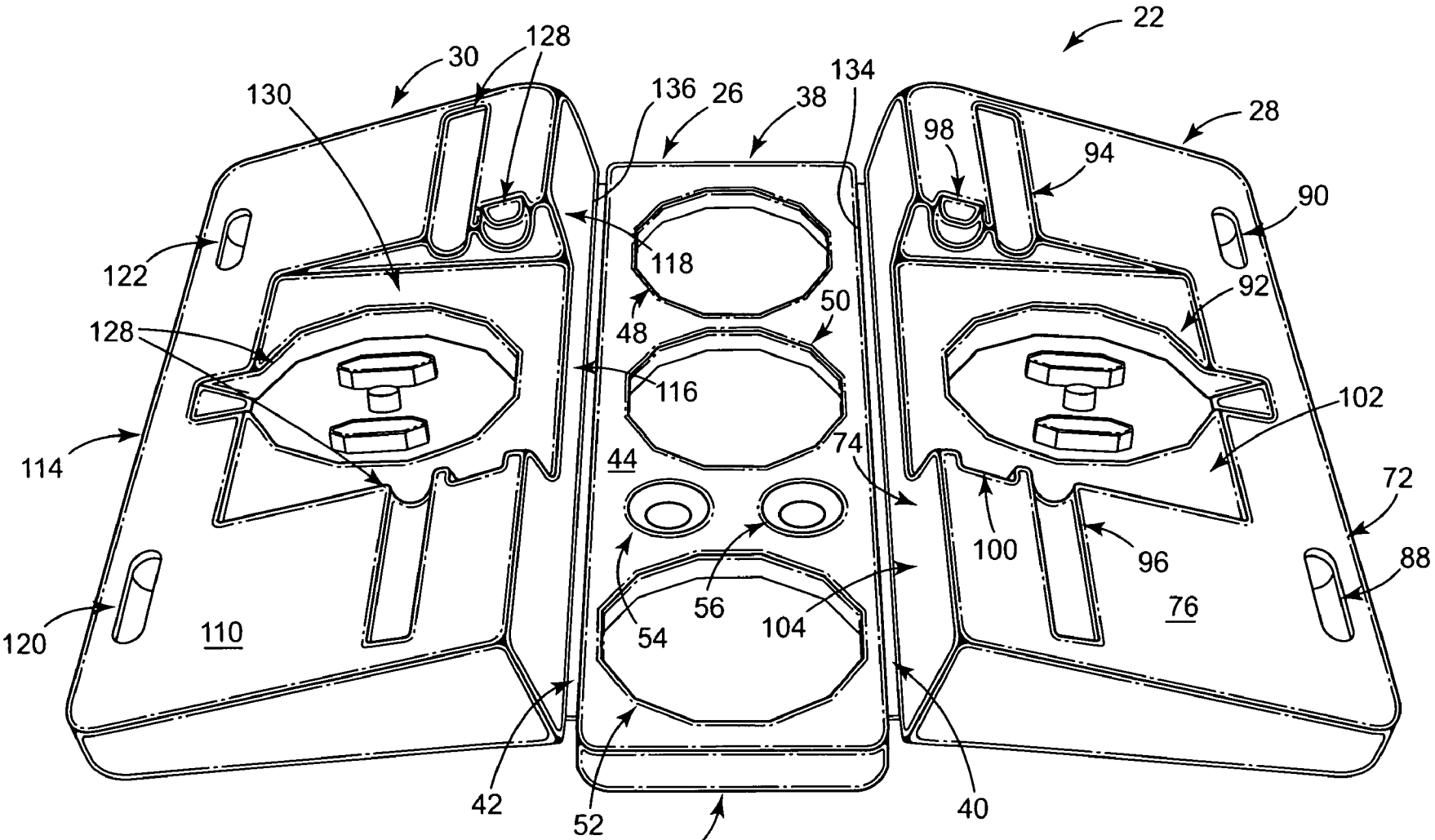
FIG. 3 is a top perspective view of the weight case of FIG. 2, according to an embodiment of the present invention.

FIGS. 2 and 3 show the weight case 22 in an open state with the exercise weight components 24 removed. The base 26 defines a front 36, a back 38, a first end 40, and a second end 42. The front 36 is positioned opposite the back 38 with the base 26 defining a length between the front 36 and the back 38. In turn, the first end 40 is positioned opposite the second end 42 with the base 26 defining a width between the first end 40 and the second end 42. The base 26 also defines a top 44 and a bottom 46.

As shown in FIG. 3, a plurality of pockets 48, 50, 52, 54, 56 are optionally formed in the top 44 of the base 26. For example, pockets 48, 50, 52 are sized and shaped, or otherwise adapted, to receive an exercise weight component 24, and more specifically, a weight plate, also described as a plate. The weight plate is a 25-lb plate, a 10-lb plate, a 5-lb plate, a 2.5-lb plate, also described as a "chip," or other weight. As shown, the pockets 48, 50, 52 are optionally substantially dodecagonal in shape, or twelve-sided. The pockets 48, 50, 52 are substantially complementary in shape to a corresponding weight plate having a dodecagonal shape. However, it should be understood that weight plates and the pockets 48, 50, 52, are optionally other shapes, such as circular, for example and the pockets 48, 50, 52 need not be similarly shaped. In turn, the pockets 54, 56 are optionally sized and shaped, or otherwise adapted, to receive collars or other accessories associated with a barbell weight set or other weight set. It should be understood that pockets 54, 56 are also optionally substantially similar to pockets 48, 50, 52, or that any of the pockets 48, 50, 52, 54, 56 are varied or shaped as desired. Each of the pockets 48, 50, 52, 54, 56 optionally includes protuberances or other projections or features (not shown) to assist in mounting an exercise weight component in one or more the pockets 48, 50, 52, 54, 56.

The base 26 of the weight case 22 is generally adapted to rest flat on a substantially horizontal surface to support the weight case 22 in a substantially upright position when the weight case 22 is in a closed state (FIG. 1). The length and width of the base 26 are optionally selected according to a size of an endcap of a retail shelf, for example. One typical endcap size is about 36 inches wide, about 72 inches high, and about 18 inches deep, for example. The base 26 is optionally about 9 inches (about 23 cm) wide and about 32 inches (about 82 cm) long, although other dimensions are contemplated. If desired, the weight case 22 also includes one or more wheel assemblies to assist in moving weight case 22. For example, a first wheel assembly 58 and a second wheel assembly 60 disposed at the back 38 of the base 26.

Figure 4:
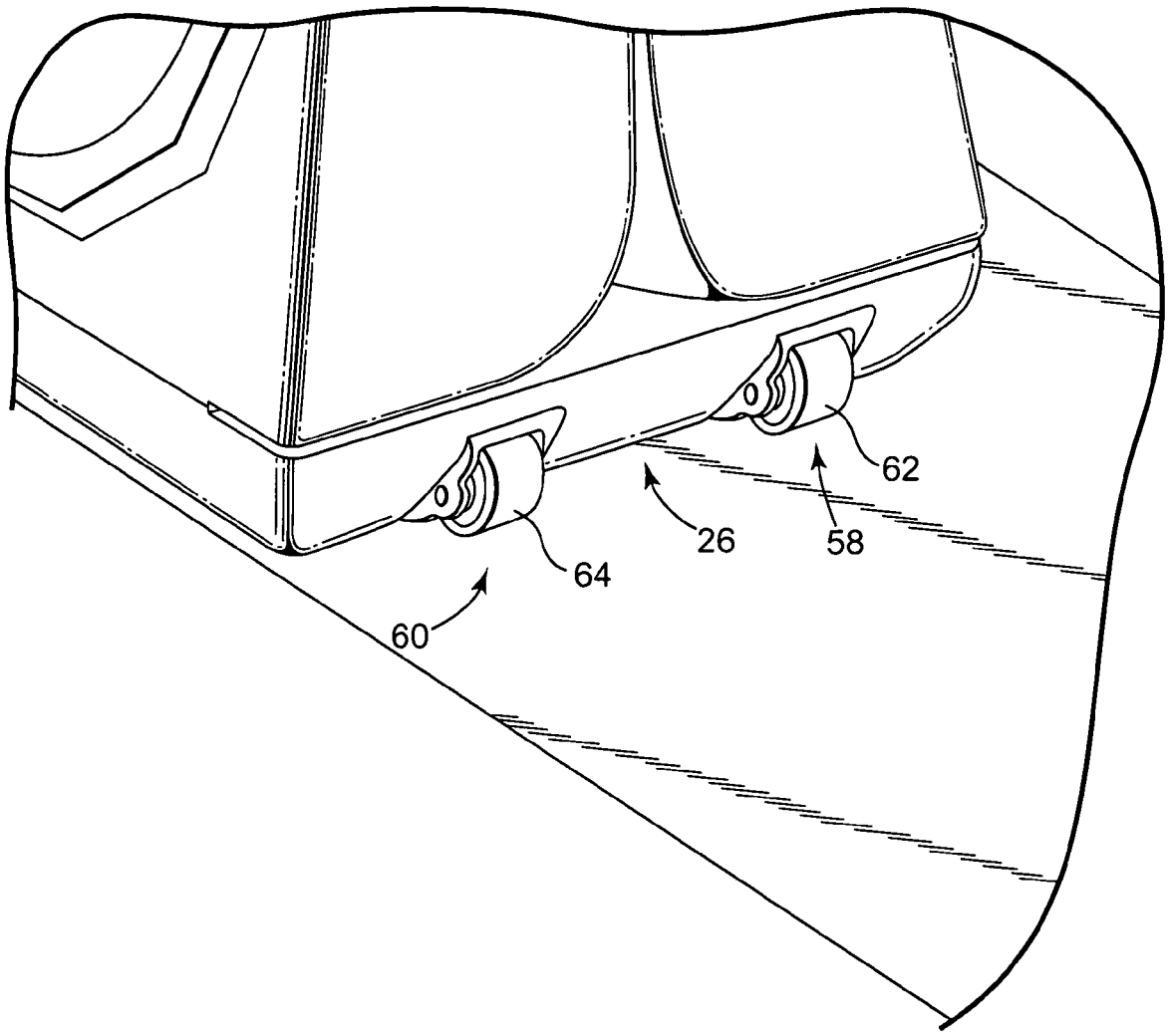
FIG. 4 is an enlarged view of first and second wheel assemblies, according to an embodiment of the present invention.

FIG. 4 shows the first and second wheel assemblies 58, 60 in greater detail. The first and second wheel assemblies 58, 60 are each optionally positioned, such as by insetting into base 26, such that a first wheel 62 of the first wheel assembly 58 and a second wheel 64 of the second wheel assembly 60 do not protrude downwardly beyond the bottom 46 of the base 26. For example, in operation, when the base 26 is resting on a support surface with the bottom 46 facing the surface, the base 26 is supported on the bottom 46 with the first and second wheels 62, 64 optionally touching the substantially horizontal surface or being spaced slightly above the substantially horizontal surface. Upon lifting the front 36 of the base 26, the first and second wheels 62, 64 then optionally contact the support surface such that the base 26 can be rolled on wheels 62, 64.

With reference to FIG. 2, the first side wall 28 defines a free end 72 and a hinged end 74 opposite the free end 72. Generally, the free end 72 is not otherwise rotatably attached or hinged to another side wall of the weight case 22. The first side wall 28 also defines an inner face 76 (FIG. 3) and an outer face 78. Pockets 80, 82 are formed in the outer face 78. Each of the pockets 80, 82 is optionally substantially similar. For example, the pocket 80 optionally includes a threaded inner projection 84 and outer projections 86, also described as protrusions. The pocket 80 is adapted to receive an exercise weight component 24, for example a weight plate such as those previously described. The inner and outer projections 84, 86 are sized and shaped, or otherwise adapted, for securing the exercise weight component 24 in the pocket 80. For example, the inner and outer projections 84, 86 are optionally adapted to be inserted through openings of the exercise weight component 24 to assist in mounting the exercise weight component 24 to the outer face 78 and in the pocket 80.

The inner projection 84 optionally includes screw threads for securing screwing a nut, threaded cap, or other retaining means to the inner projection 84. The outer projections 86 are optionally formed to be inserted through corresponding holes in a weight plate, for example, to help substantially prevent the weight plate from rotating. Additionally, the outer projections 86 are optionally used during assembly to ensure that the weight plate is assembled into the pocket 80 with a proper orientation. In this manner, the outer projections 86 help ensure that the weight plate is displayed in a desired orientation. The first side wall 28 also optionally includes a first handle 88 and a second handle 90 formed proximate the free end 72.

With reference to FIG. 3, the first side wall 28 also optionally has a plurality of pockets 92, 94, 96, 98, 100 formed in the inner face 76. The pocket 92 is optionally configured to receive an exercise weight component 24, such as a weight plate, and optionally includes projections, such as those previously described, to assist in mounting the weight plate or other exercise weight component in the pocket 92. As shown, the pocket 92 is optionally substantially complementary in shape to a weight plate having twelve sides, or a dodecagonal shape, for example. It should be understood that other shapes, circular for example, are also contemplated.

The pockets 94, 96 are optionally spaced apart in a line such that a bar, or a portion of a bar, of a barbell set is receivable within the pockets 94, 96. Additionally, the pockets 94, 96 are optionally adapted to provide a snap fit or other friction fit between the portion of the bar and the pockets 94, 96 if desired. In some instances, a bar, or portion thereof, is inserted into the pockets 94, 96 such that the bar extends over a weight plate, or other exercise component, in the pocket 92. In this manner, the pockets 94, 96 in combination with a bar provide means for retaining an exercise component in the pocket 92. Thus, one method of removing an exercise component from the pocket 92 includes removing a bar, or portion thereof, from the pockets 94, 96 prior to removing the exercise component from the pocket 92.

The pockets 98, 100 optionally act substantially similarly to the pockets 94, 96 and are optionally configured to maintain another portion of a full length bar of a barbell set, for example a connector for securing two bar portions together. The first side wall 28 also optionally includes a recessed area 102 in the inner face 76, which defines the spacing between the pockets 94, 96 and 98, 100, respectively, as referenced above. When viewed from the front 36 or the back 38, the first side wall 28 optionally defines a substantially triangular cross-section. Additionally, the first side wall 28 defines a bottom face 104 at the hinged end 74 as desired.

With reference to FIGS. 2 and 3, the second side wall 30 is optionally substantially similar to the first side wall 28. In general terms, the second side wall 30 defines an inner face 110 and an outer face 112. The second side wall 30 also extends from a free end 114 to a hinged end 116 residing opposite the free end 114. If desired, the free end 114 is not otherwise hinged or rotatably attached to another side wall of the weight case 22. The second side wall 30 also has a bottom face 118 at the hinged end 116 and a first handle 120 and a second handle 122 formed proximate the free end 114.

As will be understood in greater detail, the first handle 120 of the second side wall 30 and the first handle 88 of the first side wall 28 are symmetrically positioned, or disposed, relative to the base 26, while the second handles 90, 122 of first and second sidewalls 28, 30, respectively, are symmetrically positioned relative to the base 26, such that when the first and second side walls 28, 30 are folded together the respective handles 88, 120 and 90, 122 line up. The second side wall 30 also has pockets 124, 126 in the outer face 112 that are optionally substantially similar to the pockets 80, 82 of the first side wall 28. In turn, the second side wall 30 also includes a plurality of pockets, referenced generally as pockets 128, formed in the inner face 110 and a recessed area 130 formed in the inner face 110. For example, the pockets 128 and the recessed area 130 are optionally substantially similar to corresponding packets 92, 94, 96, 98, 100 described in association with the first side wall 28 such that the first and second side walls 28, 30 are substantially mirror images of one another.

Each of the first and second side walls 28, 30 is optionally rotatably hinged to the base 26 at a first hinge 134 and a second hinge 136, respectively. The first hinge 134 is positioned proximate an edge defined by the outer face 78 and the bottom face 104 of first side wall 28. In turn the second hinge 136 is optionally positioned along an edge defined by the outer face 112 and the bottom face 118 of second side wall 30. The first and second hinges 134, 136 are optionally formed as a door-hinge type structure, as a flexible piece of material, or as any other hinge or other appropriate structure about which the first side wall 28 or second side wall 30 is able to be rotated relative to the base 26.

Figure 5:
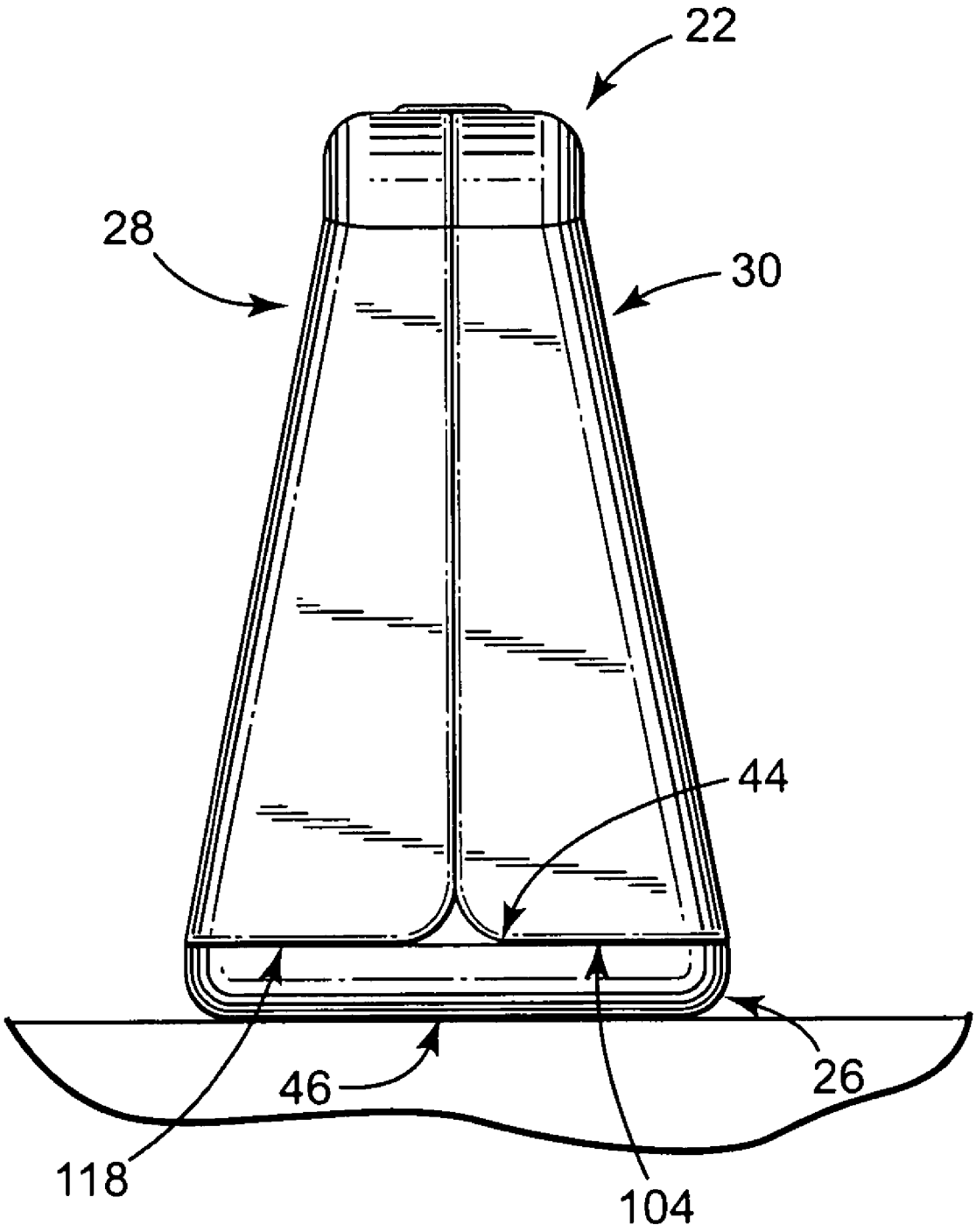
FIG. 5 is a front view of a weight case, according to an embodiment of the present invention.

With reference FIGS. 3 and 5, the weight case 22 is transitionable between the open state shown in FIG. 3 and the closed state as shown in FIG. 5. The open state includes the bottom 46 of the base 26 being positioned on a support surface (not shown) with each of the first and second side walls 28, 30 extending substantially laterally, or substantially horizontally, away from the base 26. For example, the outer faces 78, 112 of each of the first and second side walls 28, 30 optionally rest, or are otherwise supported on the support surface.

The closed state includes the bottom 46 of the base 26 being supported on the support surface. In the closed state, the first and second side walls 28, 30 optionally extend substantially vertically from the base 26 and are opposingly positioned. The inner faces 76, 110 of the first and second side walls 28, 30 are optionally abutted together or are otherwise facing toward one another. Additionally, each of the bottom faces 104, 118 of the first and second side walls 28, 30 is optionally abutted against or otherwise faces toward the top 44 of the base 26. In particular, the bottom faces 104, 118 optionally cover a portion, or substantially all of one or more of the pockets 48, 50, 52, 54, 56 of the base 26. By disposing the bottom faces 104, 118 over one or more of the pockets 48, 50, 52, 54, 56, one or more exercise weight components 24 are optionally covered and/or secured in a respective pocket. In other words, the bottom faces 104, 118 optionally act as a cover for at least a portion of one or more pockets of the base 26. Additionally, the closed state aligns the first handles 88, 120 (FIG. 7) of the first and second side walls 28, 30 combining to define a combined handle 88, 120. Similarly, the second handles 90, 122 (FIG. 7) of the first and second side walls 28, 30 optionally align to define a second combined handle 90, 122. Combined handles 80, 120, and 90, 122 are optionally secured by bands 152, thereby maintaining weight case 22 in the closed state. In other embodiments, alternate or additional means may be provided to maintain weight case 22 in the closed state.

Figure 6:
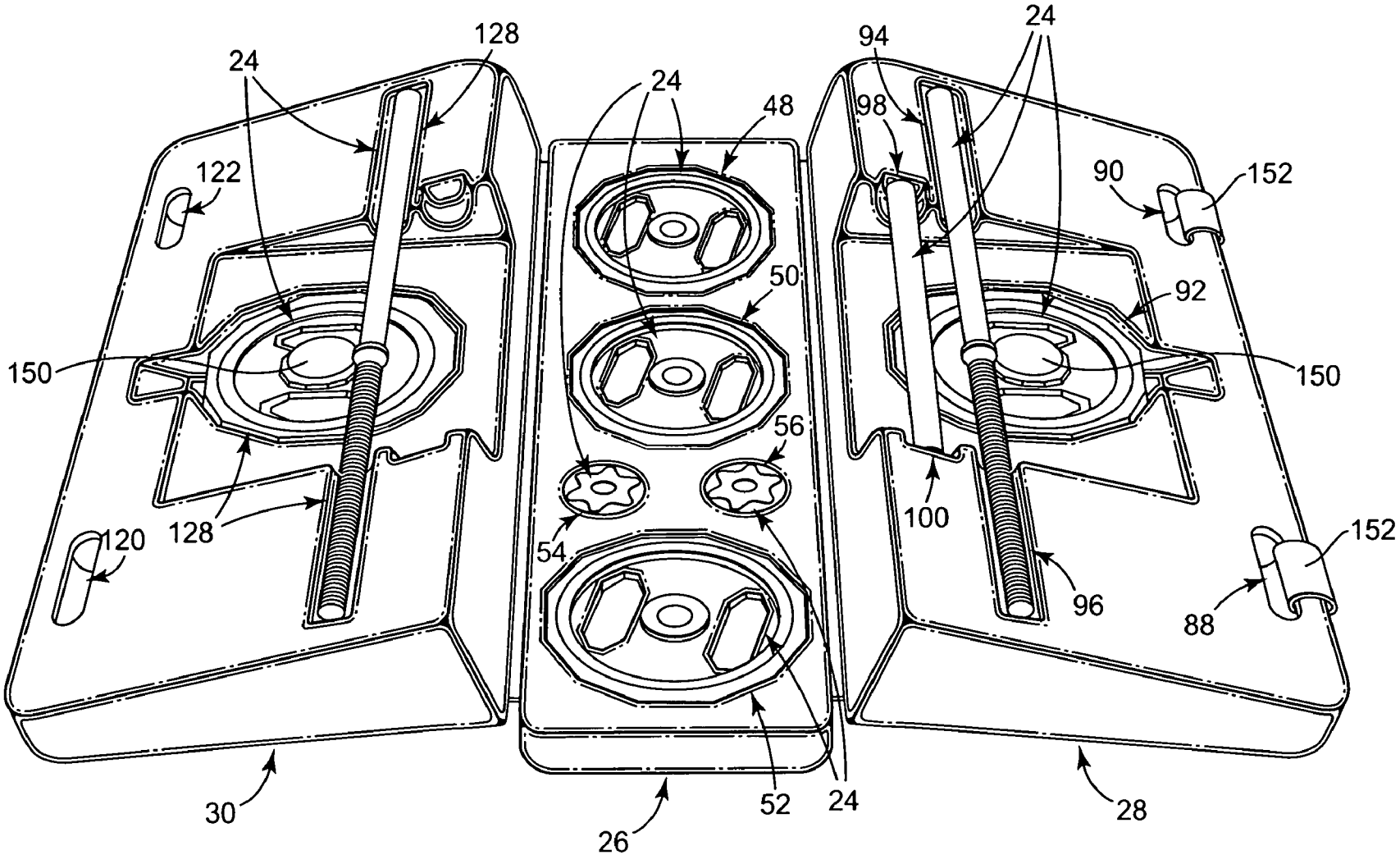
FIG. 6 is a front perspective view of an exercise weight package in an open state, according to an embodiment of the present invention.

In view of the above, a method of assembling the exercise weight package 20 includes disposing exercise weight components 24 in the pockets 48, 50, 52, 54, 56 of the base 26 as shown in FIG. 6. The pocket 48 optionally maintains a 5-lb plate, the pocket 50 optionally maintains four 2.5-lb plates, also described as "chips," and the pocket 52 optionally maintains a 5-lb plate. Each of the pockets 54, 56 optionally maintains a weight collar as shown. The method optionally includes disposing exercise weight components 24 in the pockets 92, 94, 96, 98, 100 of the first side wall 28 and exercise weight components 24 in the plurality of pockets 128 of the second side wall 30. For example, the pocket 92 of the first side wall 28 optionally maintains a 10-lb plate with the second side wall 30 also optionally maintaining a 10-lb weight. One or more screw caps 150 are optionally used to secure the weight plates in place. A first half of a bar of a barbell set is optionally maintained in the pockets 94, 96 of first side wall 28. A second half of the bar is optionally maintained with the second side wall 30. A connector for securing the first and second halves of the barbell together is optionally maintained in the pockets 98, 100 of the first side wall. Portions of bands 152 are optionally secured to the first side wall 28 through the first handle 88 and the second handle 90.

Figure 7:
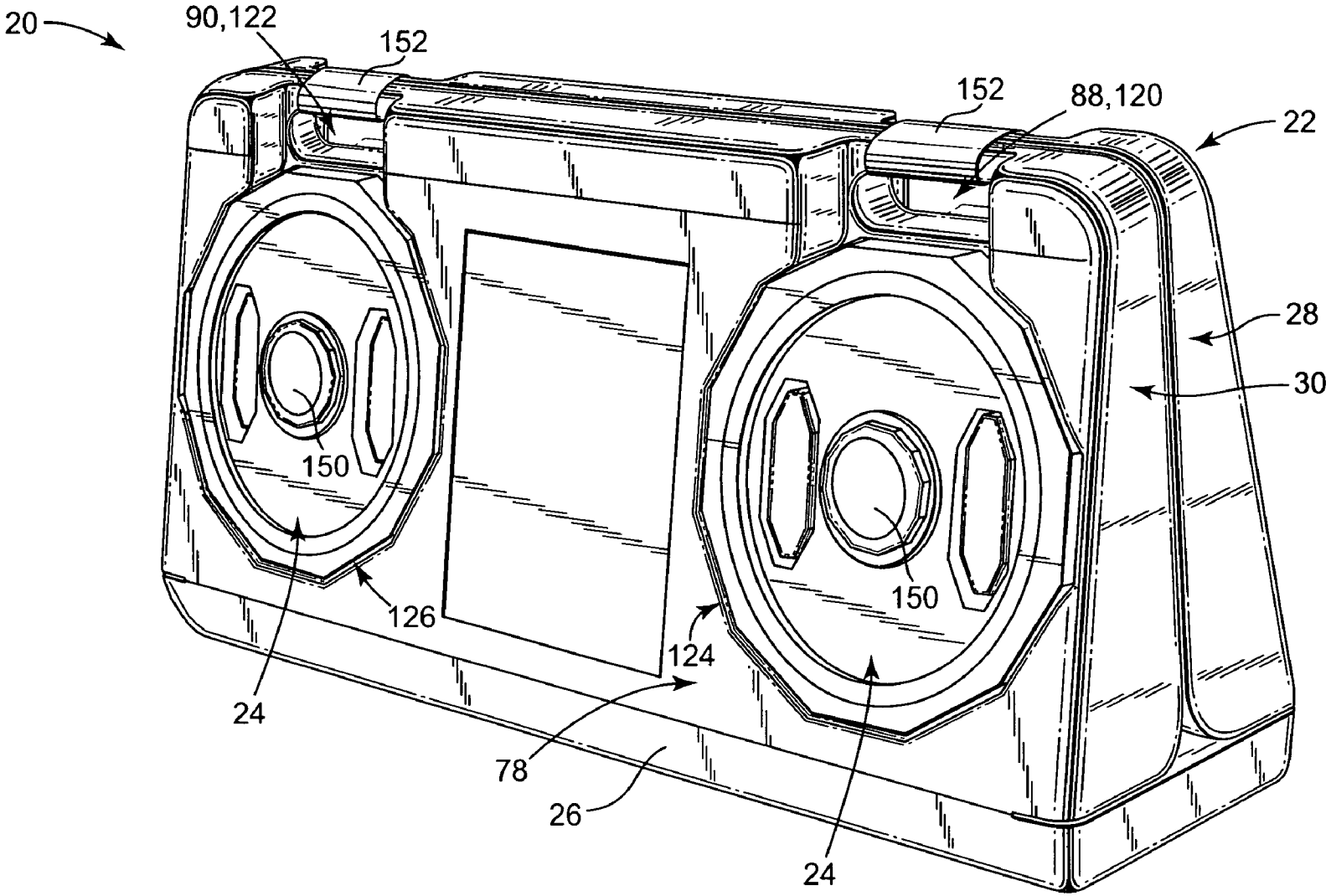
FIG. 7 is a perspective view of an exercise weight package in a closed state, according to an embodiment of the present invention.

The weight case 22 is optionally transitioned from an open state shown in FIG. 6 to the closed state as shown in FIG. 7. Each of the bands 152 is threaded through an associated one of the combined handles 88, 120 and 90, 122, and secured to retain weight case 22 in the closed state. The bands 152 may be secured using hook and loop fasteners, for example, such as those sold under the trade name VELCRO®.

Exercise weight components 24 are also optionally disposed in the pockets 80, 82 of the first side wall 28 and the pockets 124, 126 of the second side wall 30 such that the exercise weight components 24 are viewable from outside of the weight case 22. For example, screw caps 150 are optionally used to secure a 25-lb plate in each of the pockets 80, 82, 124, 126. It is also contemplated that a variety of other exercise weight components 24 be maintained in one or more of the pockets 80, 82, 124, 126. In this manner, the exercise weight components 24 are supported in a substantially vertical position in the pockets 80, 82, 124, 126 and are also optionally viewable, as well as touchable, from the outer faces 78, 112 of the first and second side walls 28, 30, respectively when the weight case 22 is in the closed state (FIG. 7).

In this manner, the weight case 22 is optionally disposed in a retail environment in a method of displaying exercise weight components 24 to observers. In particular, the exercise weight components 24 are maintained in the respective pockets 80, 82, 124, 126 and maintained therein such that an observer is able to optionally view and/or touch the exercise weight components 24 when the weight case 22 is in the closed state. The exercise weight components are presented directly to the observer in a visually pleasing manner and by viewing and/or touching the exercise weight components 24, the observer is able to evaluate product quality and materials, and generally use a more "hands on" approach to evaluate the product.

When properly sized, the weight case 22 is optionally disposed on a support surface of an endcap (not shown) with the weight case 22 being disposed within an outer perimeter of the support surface of the endcap. A typical endcap surface is about 36 inches wide and about 18 inches deep with the endcap being about 72 inches in height.

An observer wishing to remove the exercise weight package 20 from the retail environment optionally grasps one or both of the combined handles 88, 120 and 90, 122 to position the exercise weight package 20 on a substantially horizontal support surface. The observer then lifts the front 36 of the base 26 away from the substantially horizontal support surface such that the exercise weight package 20 is supported on the first and second wheel assemblies 58, 60. The observer is then able to roll the exercise weight package 20 to another location, for example to a point-of-sale, such as a sales counter in the retail environment.

Incorporation of the first and second wheel assemblies 58, 60 is often advantageous as the exercise weight package 20 may weigh about 75 pounds or more, about 135 pounds or more, about 150 pounds or more, and other relatively heavy weights. It should be understood that the exercise weight package 20 presents advantages in an ability to display the exercise weight components 24 using the weight case 22 itself, as well as advantages in mobility of the exercise weight package 20 via the first and second wheel assemblies 58, 60. Additionally, the compact folding design uses both the base 26 as well as the first and second side walls 28, 30 to support or otherwise maintain the exercise weight components 24. By using a substantially flat base 26 and disposing weights in the base 26, the first side wall 28, and the second side wall 30, the weight case 22 facilitates display on structures commonly found in retail environments, such as endcaps of shelving units in stores.

Figure 8:
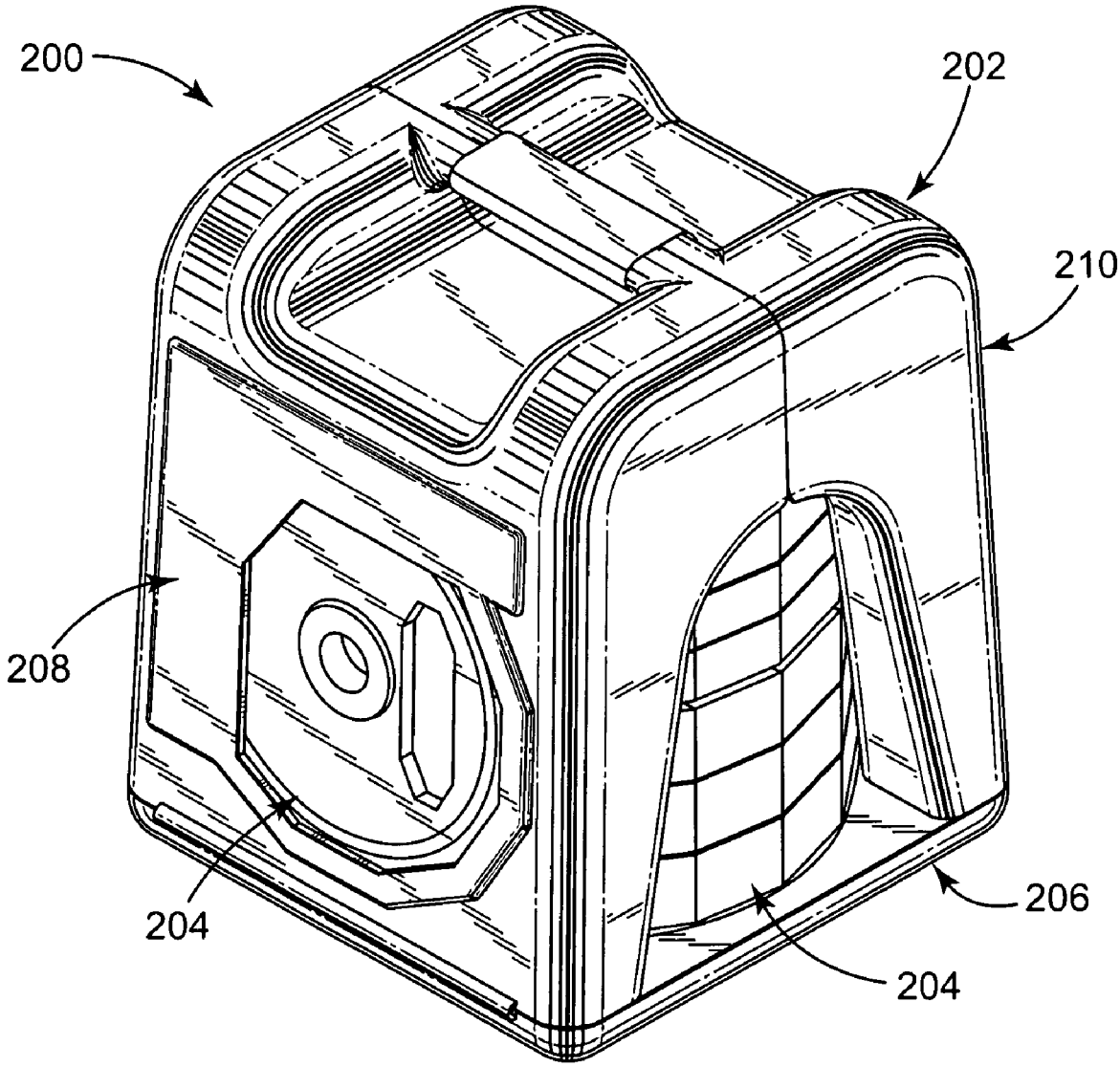
FIG. 8 is a perspective view of an exercise weight package in a closed state, according to an embodiment of the present invention.

FIG. 8 shows another exercise weight package 200 from a perspective view. The exercise weight package 200 includes a weight case 202 maintaining exercise weight components 204. In general terms, the weight case 202 includes a base 206, a first side wall 208, and a second side wall 210.

Figure 9:
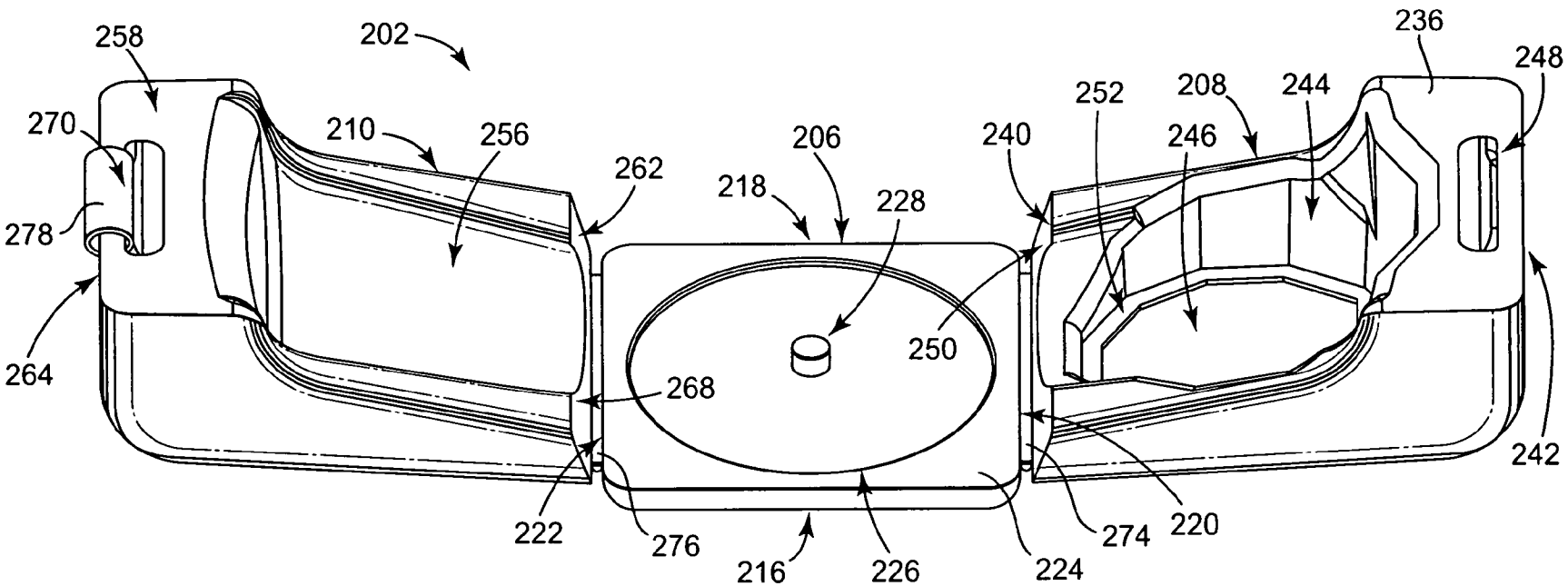
FIG. 9 is a perspective view of a weight case in an open state, according to an embodiment of the present invention.

FIG. 9 shows the weight case 202 from a perspective view and in an open state. With reference to FIG. 9, the base 206 of the weight case 202 defines a front 216, a back 218, a first end 220, and a second end 222. The front 216 and the back 218 are opposingly arranged and define a length of the base 206. In turn, the first end 220, and the second end 222 are opposingly arranged and define a width of the base 206. For example, the base 206 is about 10 inches (about 25 cm) wide and about 10 inches (about 25 cm) long, although other dimensions are contemplated. The base 206 also defines a top 224, and a bottom (not shown) opposite the top 224, and has a pocket 226 formed in the top 224. The pocket 226 optionally includes a protrusion 228, also described as a projection, projecting upwardly from the top 224. The pocket 226 is adapted or is otherwise sized and shaped to receive an exercise weight component 204, for example a weight plate, or plate, such as those previously described. In turn, the protrusion 228 is adapted or otherwise sized and shaped to project through a portion of the exercise weight component 204, for example through a central portion of a weight plate.

The base 206 is optionally substantially square in shape in the illustrated exemplary embodiment, although a variety of other shapes are also contemplated. The base 206 also optionally includes wheels as described with reference to FIG. 4 (not shown) or other means for facilitating movement of the exercise weight package 200. The base 206 is adapted to rest, or otherwise be supported with the bottom of the base 206 resting on a support surface (not shown).

Figure 10:
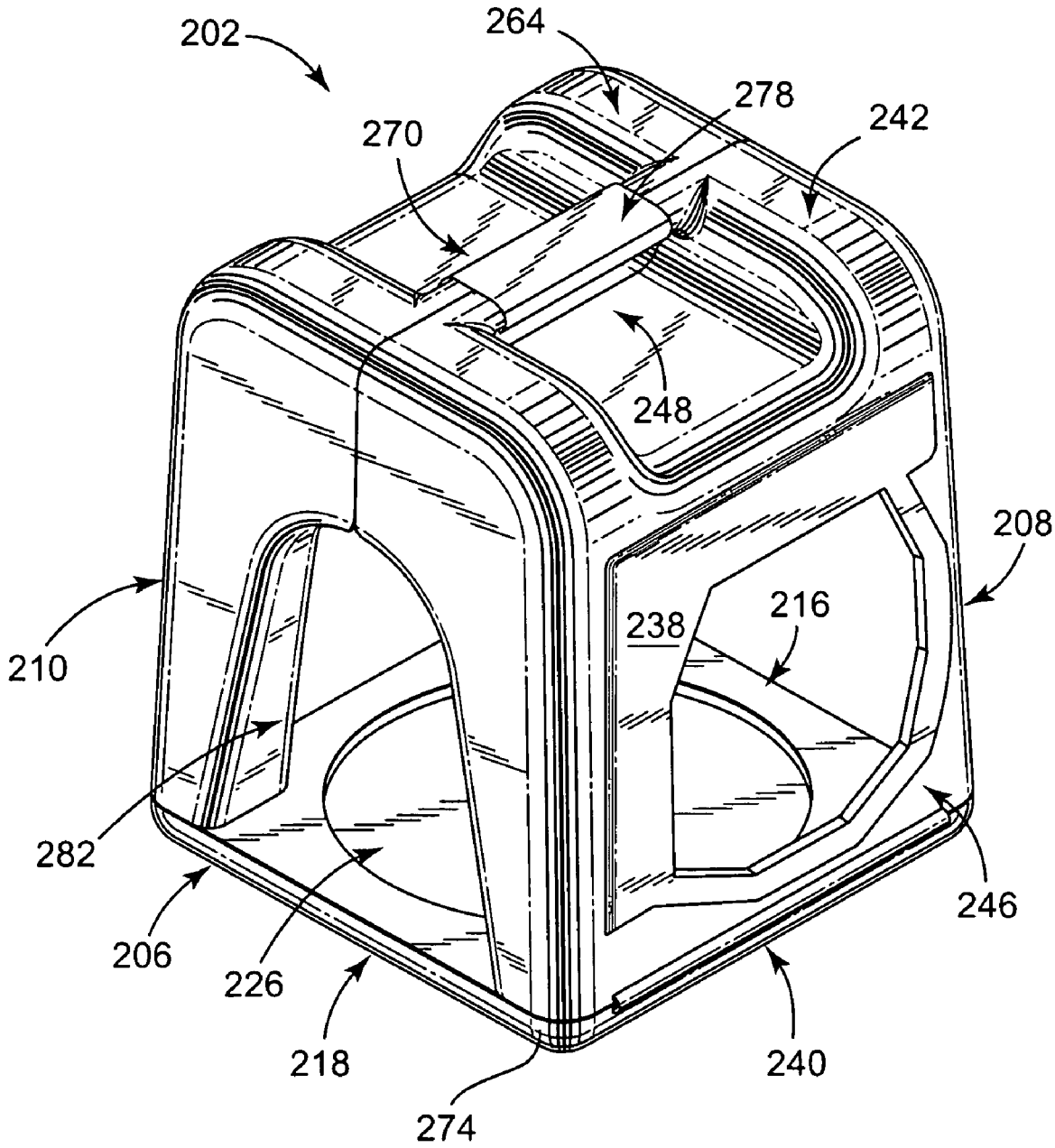
FIG. 10 is a perspective view of a weight case in a closed state, according to an embodiment of the present invention.

FIG. 10 shows the weight case 202 in a closed state from a perspective view. With reference to FIGS. 9 and 10, the first side wall 208 defines an inner face 236 and an outer face 238 opposite the inner face 236. The first side wall 208 also has a hinged end 240 and a free end 242. The free end 242 is located opposite the hinged end 240 and if desired is not rotatably secured or otherwise hinged to another side wall of the weight case 202. The first side wall 208 also has a pocket 244 sized and shaped or otherwise adapted to receive and maintain exercise weight components 204. In one embodiment, the pocket 244 is optionally adapted to maintain one of the weight components 204 in a substantially vertical position when the weight case 202 is in the closed state. As shown, the pocket 244 is optionally formed with portions defining a substantially twelve-sided or dodecagonal shape, although a variety of shapes are contemplated. The first side wall 208 also optionally has an opening 246 from the pocket 244 to the outer face 238. The opening 246 is formed as desired, but is optionally formed as a somewhat irregular multi-lateral shape as shown in FIGS. 9 and 10. Additionally, the opening 246 is sized substantially smaller than an outer profile or perimeter of the exercise weight component 204 maintained in the pocket 244. In this manner, a retaining lip 252 is formed around the opening 246 such that the exercise weight component 204 can be abutted against the retaining lip 252 of the pocket 244 to help maintain the exercise weight component in a substantially vertical position while being viewable through the opening 246 from the outer face 238. Additionally, the first side wall 208 optionally forms a handle 248 and a bottom face 250, the handle 248 positioned opposite the bottom face 250 and proximate the free end 242.

The second side wall 210 defines an inner face 258, an outer face (not shown), a hinged end 262, a free end 264, a recessed area 256, a bottom face 268, and a handle 270. The inner face 258 is disposed substantially opposite the outer face. In turn, the hinged end 262 is disposed opposite the free end 264 with the second side wall 210 defining a height between the hinged end 262 and the free end 264. The recessed area 256 is optionally shaped to substantially follow a contour of one or more of the exercise weight components 204 stacked in pocket 226. For example, the recessed area 256 is optionally substantially arcuate in shape. The handle 270 is disposed substantially opposite the bottom face 268 and proximate the free end 264. As will be described in greater detail, the handle 270 is located in a substantially symmetrical position to the handle 248 of the first side wall 208 relative to the base 206.

With the above in mind, the first and second side walls 208, 210 are optionally attached to the base 206 at a first hinge 274 and a second hinge 276, respectively. The first hinge 274 optionally takes a variety of forms, but is generally adapted or otherwise sized and shaped to rotatably connect the first side wall 208 to the base 206 such that the first side wall 208 can be transitioned between the open state (FIG. 9) and the closed state (FIG. 10) as shown. The first hinge 274 connects the hinged end 240 of the first side wall 208 and the first end 220 of the base 206. The first hinge 274 is optionally disposed proximate an edge formed by the bottom face 250 and the outer face 238 of the first side wall 208.

The second hinge 276 operates in a substantially similar manner with respect to the second side wall 210 and the base 206. For example, the second hinge 276 also optionally takes a variety of forms and connects the second end 222 of the base 206 to the hinged end 262 of the second side wall 210. The second hinge 276 is optionally located proximate a corner formed by the outer face (not shown) of the second side wall 210 and the bottom face 268 of the second side wall 210.

The weight case 202 is transitioned between the open and closed states by moving the inner faces 236, 258 toward one another to the closed state and away from one another to the open state. The base 206 is optionally supported on a substantially horizontal surface in both the closed and open states, as well as during transition therebetween. The open state optionally includes the base 206 being supported with the bottom of the base 206 resting on the substantially horizontal surface and the first and second side walls 208, 210 extending substantially away from each other. In turn, the closed state optionally includes the bottom of the base 206 supported on the substantially horizontal surface with each of the first and second side walls 208, 210 extending substantially vertically such that the inner faces 236, 258 face each the other. Additionally, the closed state optionally includes the handles 248, 270 aligned to define a combined handle 248, 270 through each of the first and second side walls 208, 210. The weight case 202 is optionally secured in the closed state by securing a band 278 through the combined handle 248, 270.

As shown in FIG. 10, first and second side walls 208, 210 are shaped such that when the free ends 242, 264 thereof are brought together in the closed state, portions of each of the first and second side walls 208, 210 curve away from the other to define a front window 280 (FIG. 12) and a back window 282. Each of the front and back windows 280, 282 are optionally substantially similar in size and shape. For example, each of the front and back windows 280, 282 defines a substantially arcuately-shaped window for viewing into the weight case 22, although other shapes are contemplated.

Figure 11:
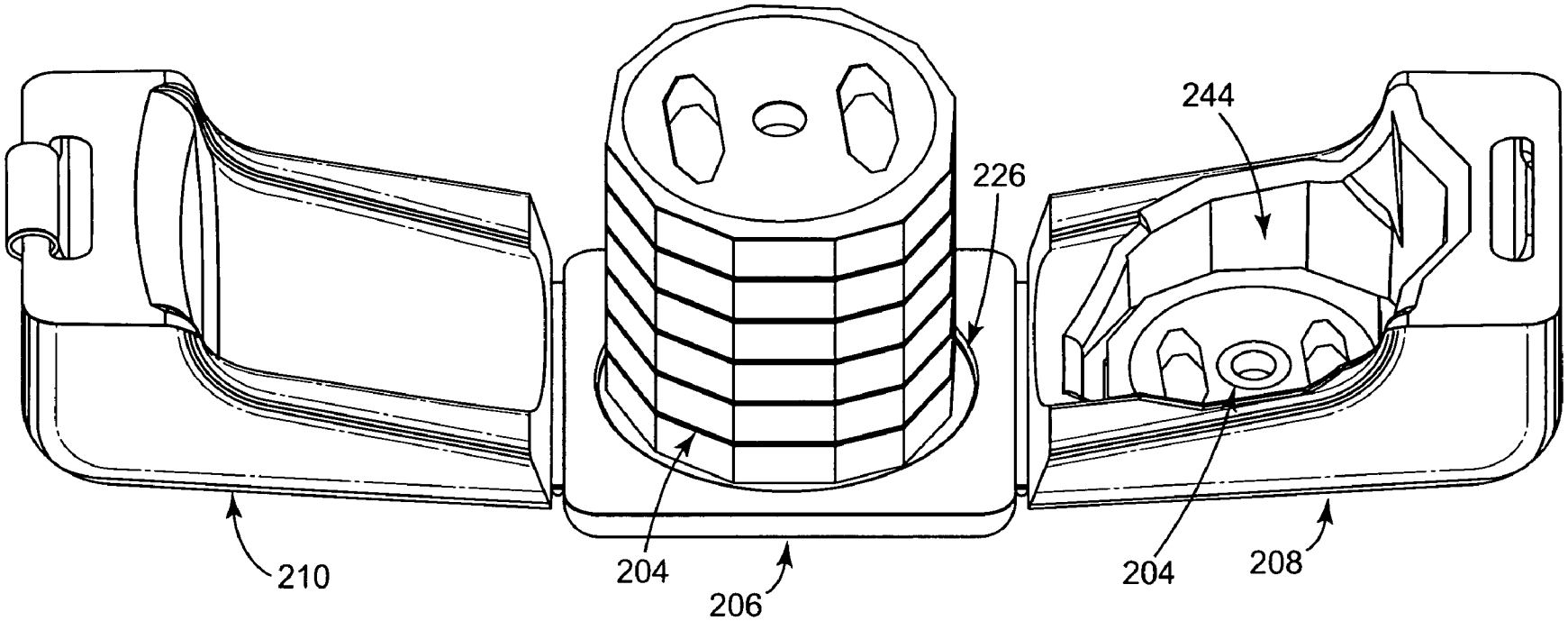
FIG. 11 is a perspective view of an exercise weight package in an open state, according to an embodiment of the present invention.

In view of the above, and with reference to FIG. 11, a method of assembling the exercise weight package 200 includes disposing a stack of exercise weight components 204, for example, a stack of weight plates of substantially similar or varying size on the base 206. In particular, the exercise weight components 204 are optionally stacked in the pocket 226. A stack of exercise weight components 204 optionally includes three 2.5-lb plates, four 5-lb plates, and two 10-lb plates, for example. It should be understood that a variety of combinations are also contemplated. Regardless, the stack of exercise weight components 204 is optionally placed with at least one of the exercise weight components 204 disposed in the pocket 226 of the base 206 with the protrusion 228 (FIG. 9) assisting in securing the exercise weight component or components 204 relative to the base 206. Additionally, at least one exercise weight component 204, for example, a 2.5-lb plate, is disposed in the pocket 244 and abutted against the retaining lip 252 of the pocket 244 such that a portion of the exercise weight component is optionally viewable and/or touchable through the opening 246 from the outer face 238 of the first side wall 208.

Figure 12:
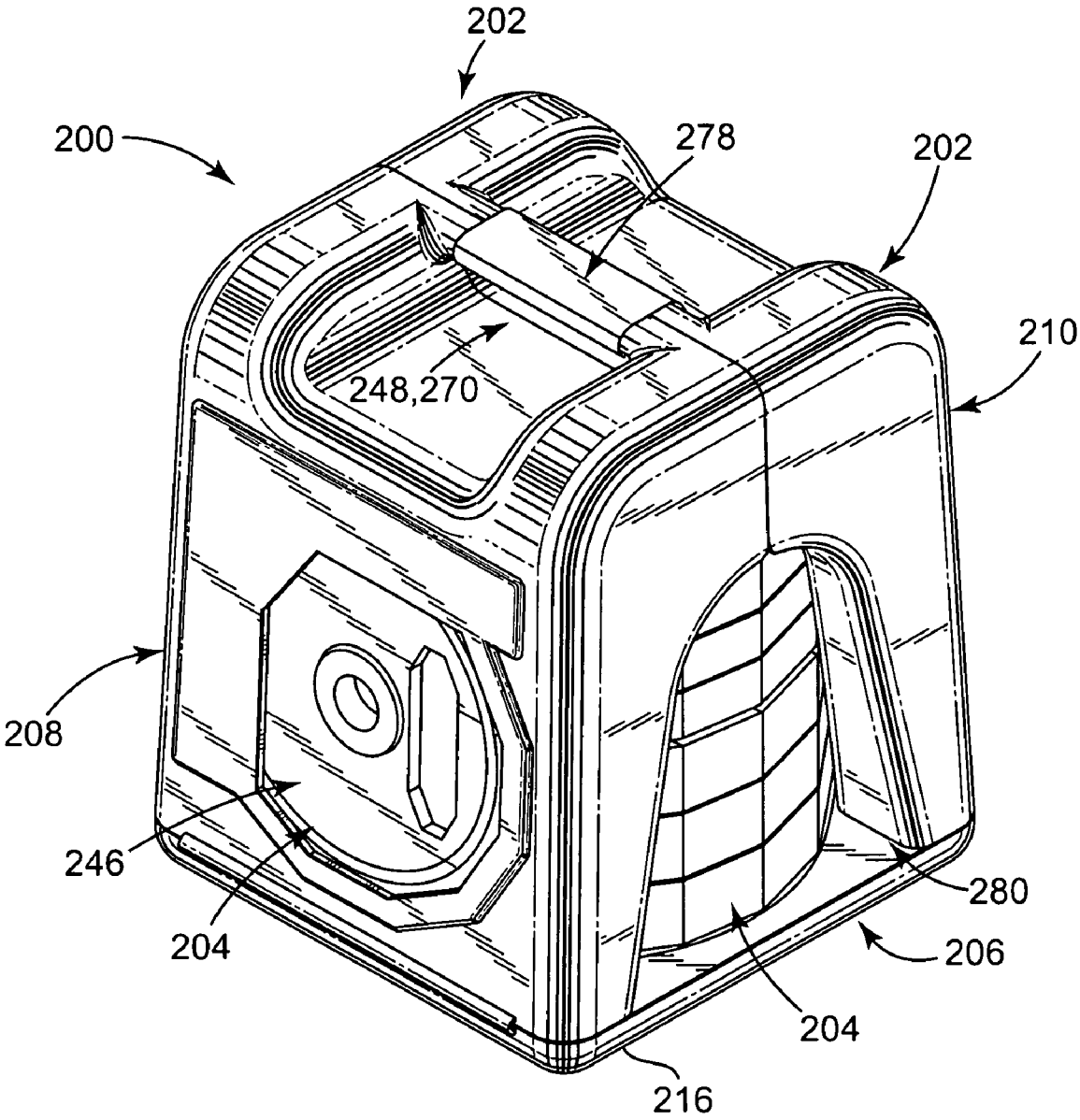
FIG. 12 is a perspective view of an exercise weight package in a closed state, according to an embodiment of the present invention.

As shown in FIG. 12, the weight case 202 is then optionally transitioned to the closed state. The exercise weight components 204 are maintained in the pocket 226 via substantially horizontal orientation and exercise components 204 are maintained in the pocket 244 in a substantially vertical orientation when the base 206 is supported on a substantially horizontal surface. In this manner, the exercise weight component 204 in pocket 244 is viewable and/or touchable from the outer face 238 of the first side wall 208 through the opening 246. Additionally, the stack of exercise weight components 204 in pocket 226 are viewable and/or touchable through the front and back windows 280, 282 formed by the combination of the first and second side walls 208, 210. As shown, the first and second side walls 208, 210 are optionally secured in the closed state by looping the band 278 through the combined handle 248, 270 of the first and second side walls 208, 210 and about the free ends 242, 264, for example. The band 278 is optionally a strap including hook and loop fasteners, such as those sold under the trade name VELCRO®, or another type of fastener, such as a cable tie. In other embodiments, additional or alternate means for securing side walls 208, 210 in the closed state may be provided.

In this manner, the exercise weight package 200 is optionally disposed in a retail environment in a method of displaying exercise weight components 204 to observers. For example, the exercise weight components 204 stacked in a substantially horizontal fashion are optionally viewable and/or touchable through one or both of the front and back windows 280, 282. In turn, the exercise weight component 204 maintained in a substantially vertical fashion by the pocket 244 of the first side wall 208 is optionally viewable and/or touchable, through the opening 246 from the outer face 238 of the first side wall 208. As referenced previously in association with the weight case 22, when properly sized, the weight case 202 is optionally disposed on a support surface of an endcap (not shown) with the weight case 202 being disposed within an outer perimeter of the support surface of the endcap. An observer wishing to remove the exercise weight package 200 from the retail environment optionally grasps the combined handle 248, 270 and carries the exercise weight package 200 to a point of sale (POS) or other location or rolls the exercise weight package 200 on optional wheels (not shown).

From the above, it should be understood that the exercise weight package 200 presents advantages in an ability to display the exercise weight components 204 using the weight case 202 itself, as well as advantages in mobility of the exercise weight package 200 via the combined handles 248, 270. Additionally, the folding compact design using both the base 206 and the first side wall 208 to support or otherwise maintain the exercise weight components 204 facilitates storing the exercise weight package 200 and displaying the exercise weight package 200 on structures commonly found in retail environments, such as endcaps of shelving units.

Furthermore, an observer is able to view one or more of the exercise weight components 204 in a substantially vertical position in order to see various features of the exercise weight component 204 and evaluate whether or not the observer desires to purchase the exercise weight package 200. Additionally, the observer is able to view and/or touch the exercise weight components 204 to evaluate of product quality, materials, and generally use a more "hands on" approach to evaluate the product.

The weight cases 22, 202 and weight components 24, 204 of exercise weight packages 20, 200 are formed using any of a variety of suitable materials and manufacturing techniques. For example, the weight cases 22, 202 are optionally formed of polymeric material, such as those amenable to molding manufacturing techniques. The weight cases 22, 202 provide sufficient strength and rigidity, while incorporating a light weight design. The weight cases 22, 202 are optionally formed using plastic injection molding, rotomolding, blow molding, or other appropriate manufacturing techniques. The exercise weight components 24, 204 are formed of materials using techniques understood by those of skill in the art. For example, the exercise weight components 24, 204 are optionally formed of metallic and/or polymeric materials using casting techniques, for example.

In the foregoing detailed description, reference is made to the accompanying drawings which form a part of hereof, and in which is shown by way of illustrations of specific embodiments from which the invention may be practiced. In this regard, directional terminology, such as "vertical," "horizontal," "top," "bottom," "front," "back," "left," "right," etc., is used with reference to the orientation of the Figure(s) being described. Because components of the embodiments of the present invention can be positioned in a number of different orientations, the directional terminology is used for purposes of illustration and is in no way limiting. It is to be understood that other embodiments may be utilized and structural or logical changes may be made without departing form the scope of the present invention. The foregoing detailed description, therefore, is not to be taken in a limiting sense, and the scope of the present invention is defined by the appended claims.

What is claimed is:

1. A weight case comprising:

a barbell set including a first weight plate and a second weight plate;

a base member of substantially rigid molded plastic defining a top, a bottom, a first end, and a second end opposite the first end;

a first side member of substantially rigid molded plastic having a hinged end rotatably secured to the first end of the base member and a free end opposite the hinged end of the first side member, the first side member defining an inner face and an outer face and having a first pocket formed into the inner face, the first pocket receiving the first weight plate and having a substantially complementary shape to the first weight plate; and a second side member of substantially rigid molded plastic having a hinged end rotatably secured to the second end of the base member and a free end opposite the hinged end of the second side member, the second side member defining an inner face and an outer face and having a second pocket formed into the second side member, the second pocket receiving the second weight plate and having a substantially complementary shape to the second weight plate;

wherein the weight case defines a closed state including the first and second side members extending from the base member in the same direction such that the inner faces of the first and second side members face toward each other, the second weight plate being viewable and touchable from the second pocket when the weight case is in the closed state;

wherein the weight case defines an open state including the first and second side members extending from the base member in substantially opposite directions.

2. The weight case of claim 1, wherein the barbell set further includes a third weight plate and the top of the base member has a third pocket defining a substantially complementary shape to the third weight plate.

3. The weight case of claim 1, further comprising:

a handle proximate the free end of each of the first and second side members.

4. The weight case of claim 3, wherein the closed state further includes the handle of the first side member and the handle of the second side member aligned to define a combined handle.

5. The weight case of claim 2, wherein each of the first and second side members defines a bottom face at the hinged end, and further wherein the closed state includes the bottom face of each of the first and second side members being disposed over the top of the base member thereby covering the third pocket and securing the third weight plate in the third pocket of the base member.

6. The weight case of claim 1, wherein the open state includes the bottom of the base member and the outer face of each of the first and second side members resting on a support surface.

7. The weight case of claim 1, wherein the closed state includes the base member, the first side member, and the second side member defining an interior of the weight case, the first and second side members combining to define an opening into the interior of the weight case.

8. The weight case of claim 1, wherein each of the first and second side members are substantially triangular in cross-section.

9. The weight case of claim 1, further comprising:

at least one wheel secured to the base member.

10. The weight case of claim 1, wherein the barbell set further includes a bar for receiving the first and second weight plates, wherein the first side member further has a pair of pockets formed into the inner face on opposite sides of the first pocket, the pair of pockets receiving the bar with a snap fit such that the bar extends over the first weight plate.

* * * * *